US006404400B1

(12) United States Patent
Tulloch

(10) Patent No.: US 6,404,400 B1
(45) Date of Patent: Jun. 11, 2002

(54) ANTENNA MOUNT ASSEMBLY

(75) Inventor: Thomas Tulloch, Fife (GB)

(73) Assignee: Andrew Corporation, Orland Park, IL (US)

( * ) Notice: Subject to any disclaimer, the term of this patent is extended or adjusted under 35 U.S.C. 154(b) by 0 days.

(21) Appl. No.: 09/772,793

(22) Filed: Jan. 30, 2001

(51) Int. Cl.[7] ..... H01Q 3/00

(52) U.S. Cl. ..... 343/765; 343/878; 343/882

(58) Field of Search ..... 343/765, 840, 343/878, 882, 880, 890, 891, 892

(56) References Cited

U.S. PATENT DOCUMENTS

| | | | | | |
|---|---|---|---|---|---|
| 4,924,239 | A | * | 5/1990 | Ceklovsky | 343/882 |
| 5,103,236 | A | | 4/1992 | DuShane | 343/765 |
| 5,210,544 | A | | 5/1993 | Jones et al. | 343/840 |
| 5,852,423 | A | | 12/1998 | Hughes | 343/765 |
| 6,031,508 | A | * | 2/2000 | Ishizuka et al. | 343/882 |
| 6,037,913 | A | | 3/2000 | Johnson | 343/882 |
| 6,262,691 | B1 | * | 7/2001 | Austin et al. | 343/890 |

* cited by examiner

*Primary Examiner*—Don Wong
*Assistant Examiner*—Hoang Nguyen
(74) *Attorney, Agent, or Firm*—Jenkens & Gilchrist

(57) ABSTRACT

A reflector-type microwave antenna having a paraboloidal reflector having a focal point and a feed horn located at the focal point. The feed horn is adapted to launch microwave signals onto the reflector and to receive microwave reflectors from the reflector. The reflector is mounted onto a surface by a mounting assembly comprising a mounting pipe in a fixed location relative to the mounting surface, a mounting cylinder rotatably affixed to the mounting pipe, and a mounting collar affixed to the mounting cylinder. A mounting plate is affixed to both the mounting collar and to the reflector such that a movement of the mounting collar causes the reflector to move, as well. The mounting assembly also has an azimuth coarse adjuster which engages the mounting cylinder such that the mounting cylinder may be rotated in azimuth relative to the mounting pipe. Once the mounting cylinder is in position, a locking mechanism is utilized to lock the mounting cylinder in position. An azimuth fine adjuster is also included and is rotatably engaged to the mounting collar, such that the azimuth fine adjuster may rotate in azimuth the mounting collar relative to the mounting cylinder. Once the azimuth fine adjuster has moved the mounting collar into the correct position, an azimuth fine locking mechanism locks the mounting collar in a position relative to the mounting cylinder without disturbing the azimuth fine adjuster. A similar construction is also provided for positioning in elevation.

61 Claims, 9 Drawing Sheets

ANTENNA MOUNT ASSEMBLY

FIELD OF THE INVENTION

This invention is directed generally to a reflector-type microwave antenna having a mount. More specifically, it relates to a unique structure for locking the antenna in a position without moving the antenna off target.

BACKGROUND OF THE INVENTION

Reflector-type antennas direct microwave signals at a target. To optimize performance, the antennas need to be in near-perfect alignment with the target. To achieve this positioning, many antennas use an adjustable mounting assembly. The mounting assembly has adjusting mechanisms adapted to adjust the antenna in both azimuth and elevation. Once the antenna is in the proper azimuthal and elevational directions, a locking mechanism in each direction is used to lock the antenna in position. The locking mechanisms, however, act on the adjusting mechanisms, moving the antenna out of alignment. Once the antenna is out of alignment, its microwave signals are not aimed directly at the target Such a setup wastes microwave signals and the misguided signals often interfere with other devices utilizing microwave signals.

Thus, there is a need for an antenna having an adjustable mount assembly that utilizes a locking mechanism which does not cause the antenna to move out of position when locked.

SUMMARY OF THE INVENTION

Briefly, in accordance with the foregoing, an antenna is provided having a paraboloidal reflector having a focal point and a feed horn located at the focal point. The feed horn launches microwave signals onto the reflector and receives microwave reflectors from the reflector. The reflector is mounted onto a surface, such as the ground or side or roof of a building, by a mounting assembly having a mounting pipe, a mounting cylinder, and a mounting collar. The mounting pipe is stationary relative to the surface, while the mounting cylinder and mounting collar are both rotatable. A mounting plate is affixed to both the mounting collar and to the reflector such that a movement of the mounting collar causes the reflector to move as well. The mounting assembly also has an azimuth coarse adjuster which engages the mounting cylinder such that the mounting cylinder may be rotated in the azimuthal direction relative to the mounting pipe. Once the mounting cylinder is in position, a locking mechanism is utilized to lock the mounting cylinder in position. An azimuth fine adjuster is also included and is rotatably engaged to the mounting collar, such that the azimuth fine adjuster may rotate in azimuth the mounting collar relative to the mounting cylinder. Once the azimuth fine adjuster has moved the mounting collar into the correct position, an azimuth fine locking mechanism locks the mounting collar in a position relative to the mounting cylinder, without disturbing the azimuth fine adjuster. A similar construction is also provided for positioning in elevation.

By providing a locking mechanism which is located separately from the adjusting mechanism, the locking mechanism can be locked without affecting the adjusting mechanism. Therefore, the reflector can be located in a precise location and then locked in that location. This assembly provides advantages, in that microwave signals are not sent off target. Also, since the microwave signals will not be sent off course, the signals will not cause interference with other signals.

BRIEF DESCRIPTION OF THE DRAWINGS

The foregoing and other advantages of the invention will become apparent upon reading the following detailed description and upon reference to the drawings.

Figure 1:
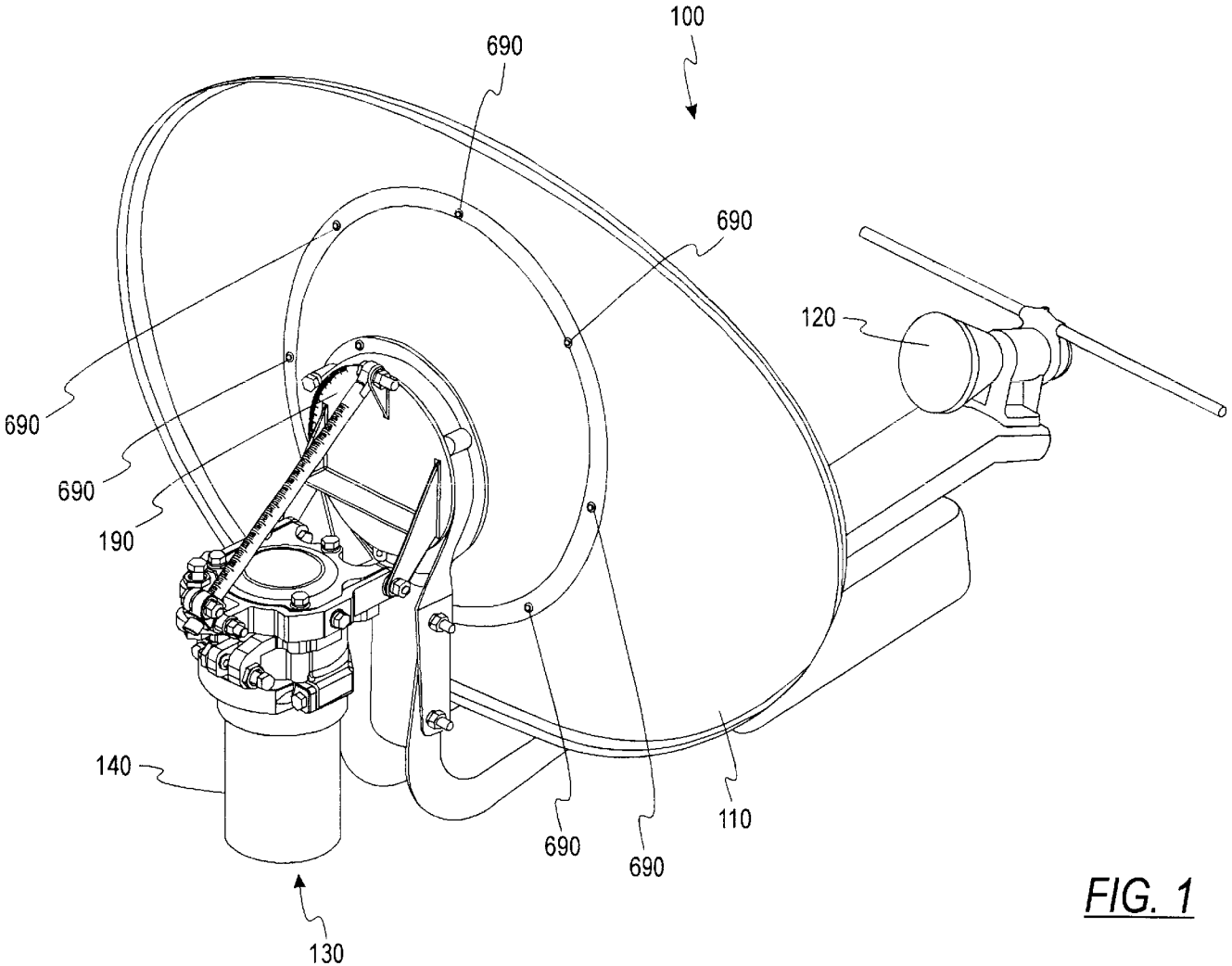
FIG. 1 is a side view of one embodiment of the present invention depicting a reflector and a mounting assembly.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE ILLUSTRATED EMBODIMENT

Referring now to the drawings, and initially to FIG. 1, an illustrative antenna 100 includes a paraboloidal reflector 110 for reflecting both transmitted and received microwave signals between a feed horn 120 and a remote station (not shown). The reflector 110 is preferably formed by biaxially stretching an aluminum disc, with the periphery of the disc being bent rearwardly and then outwardly to stiffen the reflector 110. The feed horn 120 is located at the focal point (not labelled) of the paraboloid which defines the concave surface of the reflector 110. As is well known, it is important to the performance of an antenna 100 for the reflecting surface to be manufactured to conform with the desired shape and that this shape be maintained during installation and operation of the antenna 100.

Figure 2:
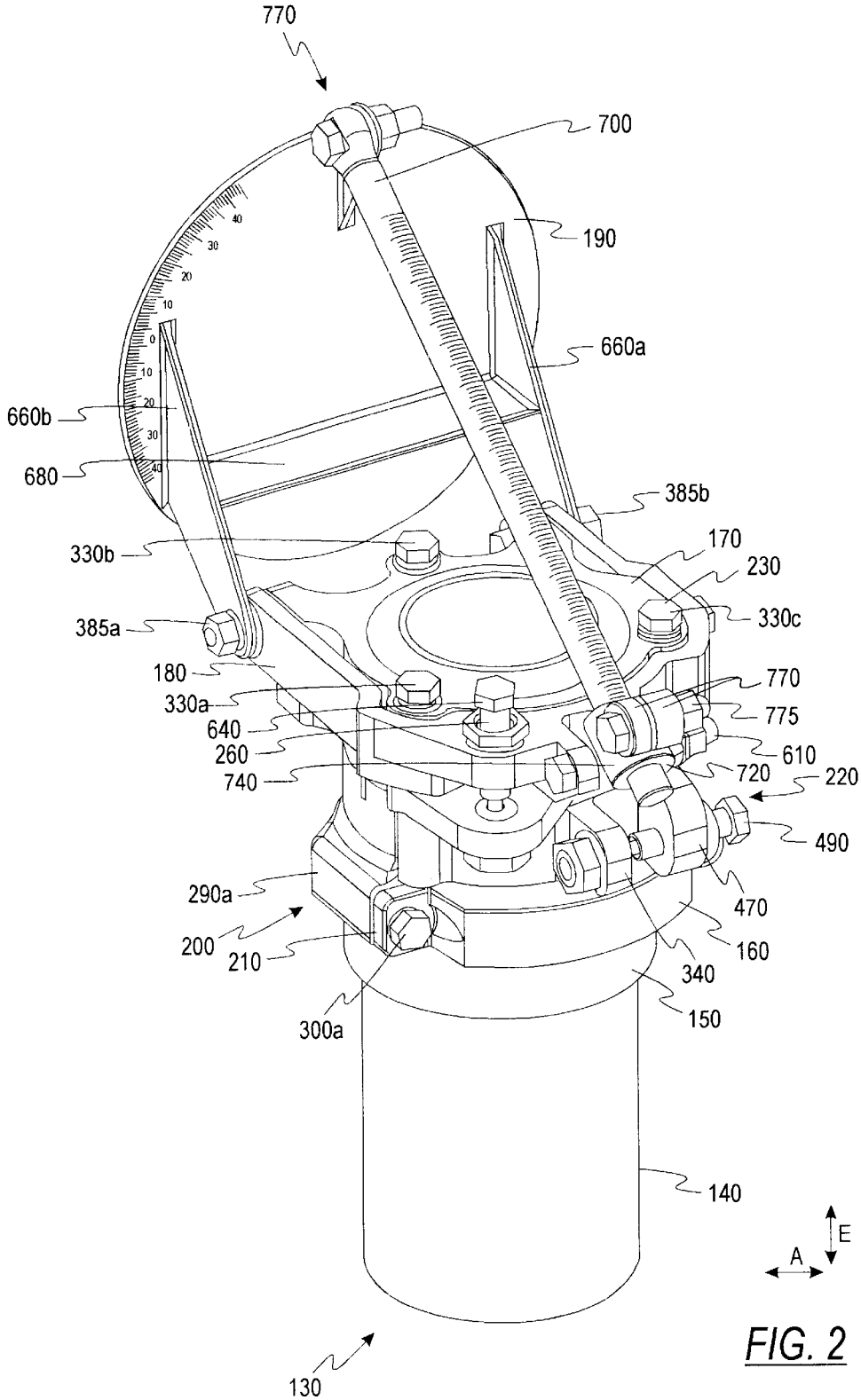
FIG. 2 is an angled view of the mounting assembly of one embodiment of the present invention.

During installation, the reflector 110 is positioned so that the number of microwave beams aimed at the target is maximized. To accomplish this, the reflector 110 must be pivotal in both azimuth and elevation (shown by arrows A and E in FIG. 2). Once the antenna 100 is pivoted to the correct position, the antenna 100 needs to be locked in that position.

Figure 3:
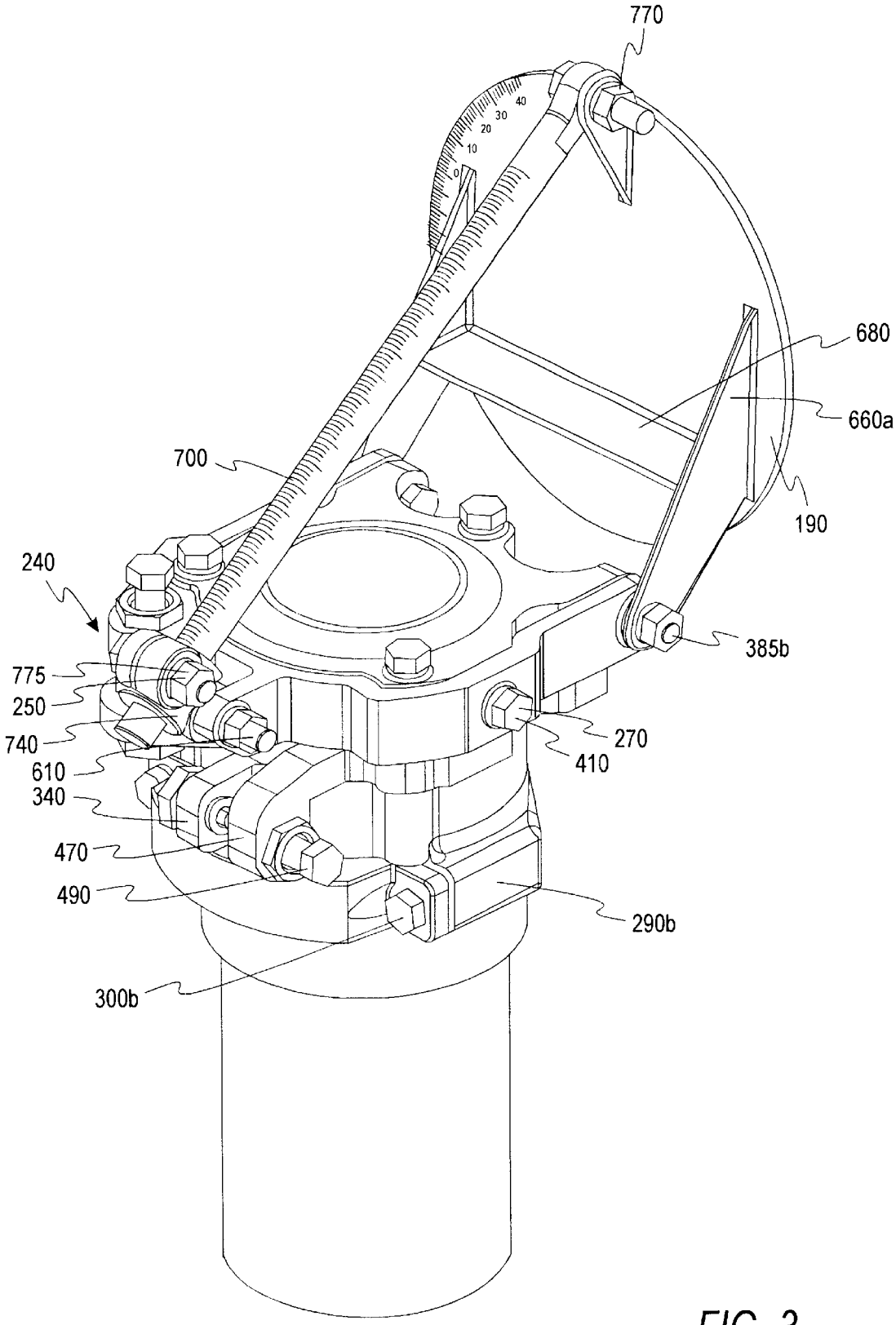
FIG. 3 is a different angled view of the mounting assembly.

Referring generally to FIGS. 1 and 3, the antenna 100 has a mounting structure 130 to mount the reflector 110 to the ground, building, or other desired location. The mounting structure 130 is made of a variety of parts acting together to provide coarse fine azimuthal adjustment and coarse and fine elevational adjustment, which will now be described in detail with reference to FIGS. 2 and 3, starting at the lower end and working up. First, the mounting structure 130 has a mounting pipe 140. The mounting pipe 140 is affixed to whatever the antenna 100 is being mounted on, for example, the ground. Once the mounting pipe 140 is affixed, it stays stationary relative to the ground or other mounted structure. Next, a mounting cylinder 150 slides over the mounting pipe 140 and nestably engages a top of the mounting pipe (not shown). On a side of the mounting cylinder 150, a c-shaped clamp 160 is affixed. The c-shaped clamp 160 and mounting cylinder 150 work together to provide the coarse azimuthal adjustment. On top of the mounting cylinder 150 is a mounting collar 170. The mounting collar 170 works with the mounting cylinder 150 to provide for the fine azimuthal adjustment. Encompassing the mounting cylinder 150 is a u-shaped mount 180. The u-shaped mount 180 works with the mounting collar 170 to provide fine elevational adjustment. The u-shaped mount 180 is attached to a mounting plate 190 which, in turn, is attached to the paraboloidal reflector is 110. The mounting plate 190 and the u-shaped mount work together to provide for coarse elevational adjustment. All of the parts are engaged such that a movement of one may cause a movement of another.

An azimuth coarse adjuster 200 is provided for coarsely (for example, in one preferred embodiment, the coarse adjuster is within a range of +/−5°, preferably +/−3° of a desired location) adjusting the azimuth of the reflector 110. The azimuth coarse adjuster 200 includes a locking mechanism 210 on the mounting cylinder 150 which, when locked, prohibits the motion of the mounting cylinder 150 relative to the mounting pipe 140 in azimuth. To finely adjust the azimuth, an azimuth fine adjuster 220 is provided between the mounting cylinder 150 and the mounting collar 170. The mounting collar 170 (and, thus, the reflector 110) is adjusted so that it is now rotatable relative to the mounting cylinder 150. Once the azimuth fine adjuster 220 puts the reflector 110 in position, an azimuth fine locking mechanism 230 is locked. The azimuth fine adjuster 220 is located separately from the azimuth fine locking mechanism 230 such that the act of locking does not move the azimuth fine adjuster 220.

An elevation coarse adjuster 240 is also provided for coarsely (for example, in one preferred embodiment, the coarse adjuster is within +/−5° and preferably +/−3° of a desired location) adjusting the elevation of the reflector 110. The elevation coarse adjuster 240 also has a locking mechanism 250 on the u-shaped mount 180. The locking mechanism 250, when locked, prohibits the elevational movement of the u-shaped mechanism relative to the mounting plate 190. An elevation fine adjuster 260 (shown in FIG. 2) is also provided to finely adjust the reflector 110 to its optimum position, as is a separate elevation fine locking mechanism 270. The elevation fine adjuster 260 acts to rotate the u-shaped mount 180 (and, thus, the reflector 110) relative to the mounting collar 170, the mounting cylinder 150, and the mounting pipe 140. The locking mechanism 270 is located separately such that once the reflector 110 is in position, the locking mechanism 270 may be locked without affecting the elevation fine adjuster 260. A more detailed discussion of all the parts, as well as the operation of one embodiment, will be described below.

Figure 4:
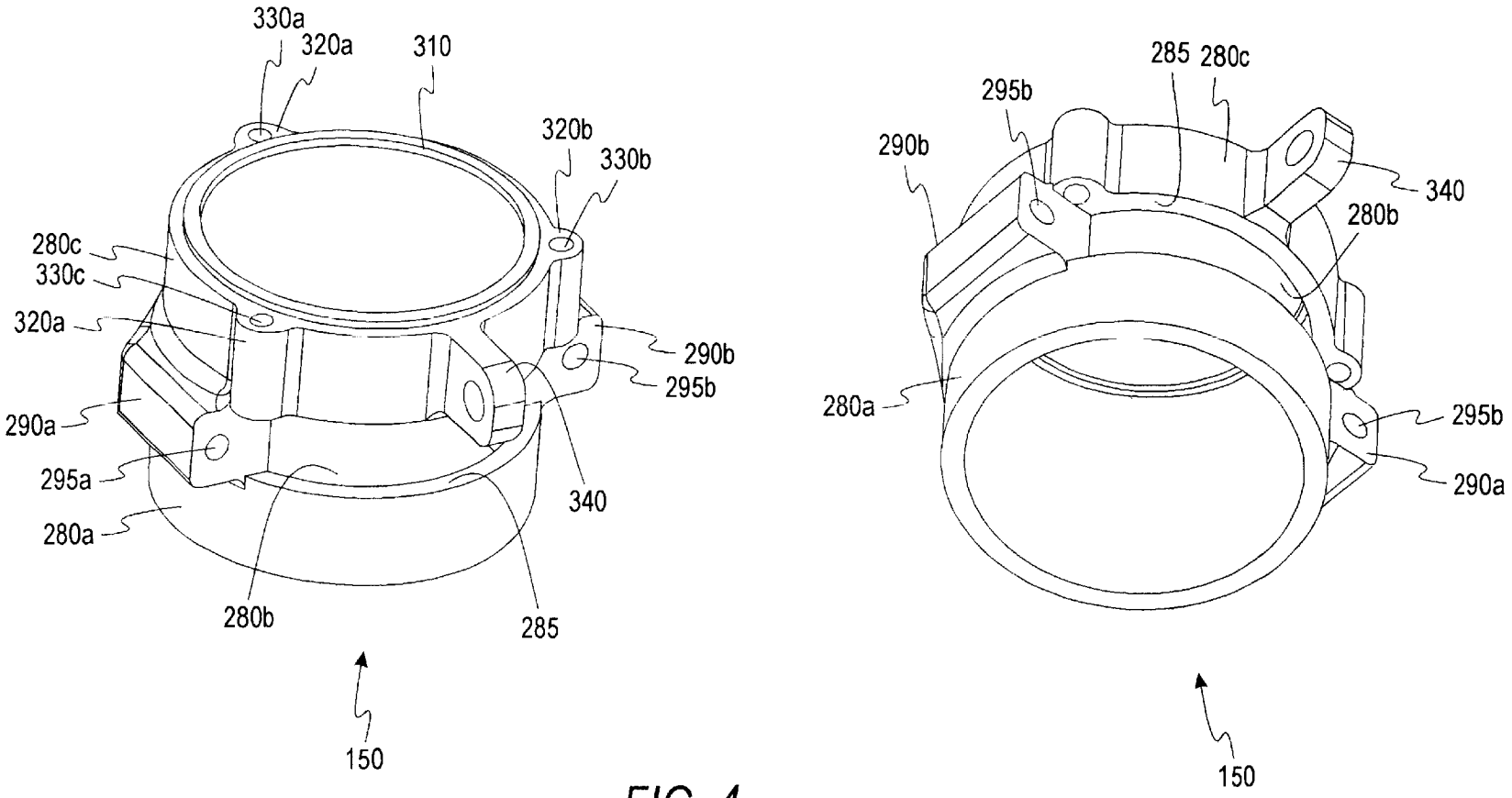
FIG. 4 is top view of a mounting cylinder according to one embodiment of the present invention.

Turning now to FIG. 4, the mounting cylinder 150 is made of three annular portions 280*a*, 280*b*, 280*c* having an inner diameter that is slightly larger than that of the mounting pipe 140 so that the mounting cylinder 150 may slide over the mounting pipe 140. A first annular portion 280*a* is a ring having a smooth outer surface and an inner surface that engages the mounting pipe 140. It is also contemplated that the mounting cylinder 150 only have two annular portions and does without the first annular portion 280*a*.

A second annular portion 280*b* is above the first annular portion 280*a* and has an outer diameter that is less than an outer diameter of the first annular portion 280*a*, creating an edge 285. The second annular portion 280*b* also has two opposite flanges 290*a*, 290*b* extending outwardly, each of which has a hole 295*a*, 295*b* capable of accepting a clamp bolt 300*a*, 300*b* (shown in FIGS. 2 and 3) in a particular direction. The opposite flanges and corresponding clamp bolts are used to coarsely adjust the reflector in azimuth.

A third annular portion 280*c* is above the second annular portion 280*b* and has an outer diameter which is approximately equal to the outer diameter of the first annular portion 280*a*. The third annular portion 280*c* has an inwardly extending lip 310 which causes the mounting cylinder 150 to rest on top of the mounting pipe 140 without sliding down the pipe. Around the perimeter of the third annular portion 280*c*, there are three through holes 320*a*, 320*b*, 320*c*, each capable of accepting an off bolt 330*a*, 330*b*, 330*c* (shown in FIG. 2). The three off bolts 330*a*, 330*b*, 330*c* are positioned such that they are in a direction perpendicular to the direction of the clamp bolts 300*a*, 300*b* of the second annular portion 280*b*. The three off bolts act as the locking mechanism in the azimuth direction, as will be discussed in more detail later.

An arm 340 on the third annular portion 280*c* accepts a captivated ball-nosed bolt for the purpose of finely adjusting the reflector in azimuth, as will be described later. The bolt accepted by the arm 340 is in a third direction that is perpendicular to both the clamp bolts 300*a*, 300*b* of the second annular portion 280*b* and the three off bolts 330*a*, 330*b*, 330*c* of the third annular portion 280*c*. It is also contemplated that the ball-nosed bolt, clamp bolts, and off bolts are not all perpendicular to each other, but in some other angled relationship relative to each other.

Figure 5:
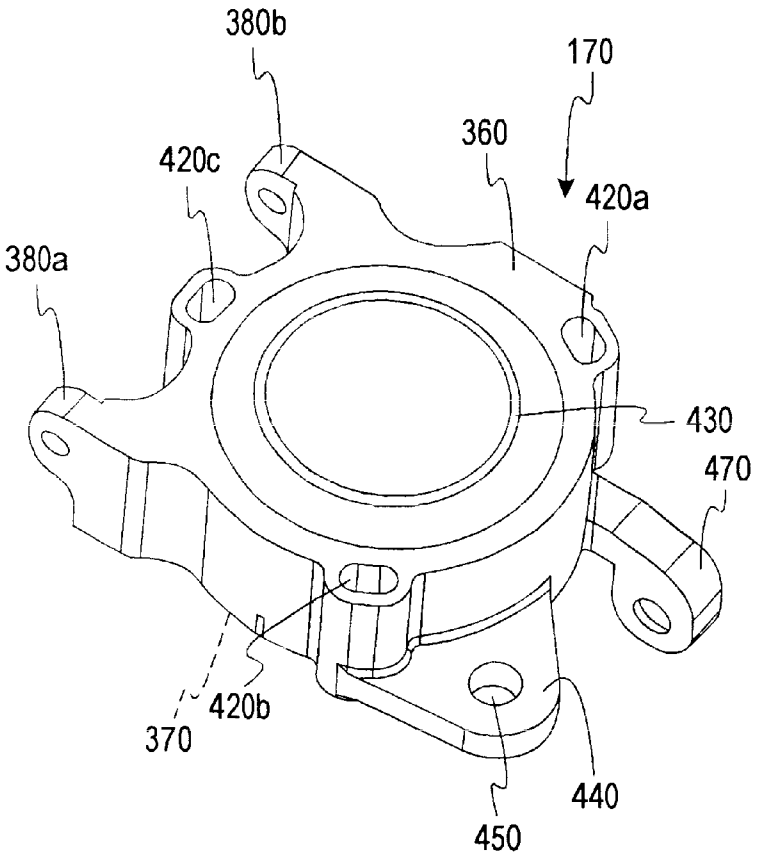
FIG. 5 is a bottom view of a mounting collar according to one embodiment of the present invention.
Figure 5:
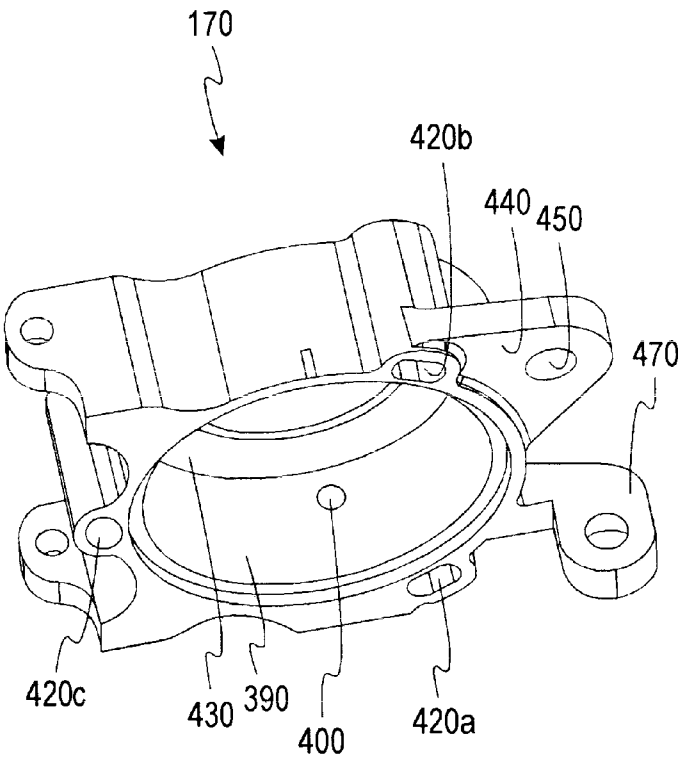

As shown in FIG. 5, a mounting collar 170 is slid on top of the mounting cylinder 150. The mounting collar 170 has a top portion 360 and a bottom portion 370. The top of the mounting collar 170 has two outwardly extending feet 380*a*, 380*b* for receiving hinge bolts 385*a*, 385*b*. As discussed later, the hinge bolts act to keep the reflector locked at an elevation. On a side 390 of the mounting collar 170 is another through hole 400 capable of receiving a side bolt 410 in the same direction, which also works as a lock for the elevation adjustment. Extending from the top portion 360 to the bottom portion 370 are three through holes. The three through holes 420*a*, 420*b*, 420*c* are in alignment with the three through holes 320*a*, 320*b*, 320*c* of the mounting cylinder 150 and, therefore, work in the locking mechanism. The top portion 360 has a recess 430 which nestably engages with the third portion of the mounting cylinder 150. The annular recess 430 engages the mounting cylinder 150 such that the mounting cylinder 150 and the mounting collar 170 move together unless opposing forces are applied to them. In another embodiment, the mounting collar 170 does not have an annular recess for nestably engaging the third portion of the mounting cylinder 150. The top portion 360 may be smooth and merely rest atop the mounting cylinder 150.

Extending outwardly from the bottom of the mounting collar 170 is a flange 440 with a hole 450 capable of receiving a bolt in a direction perpendicular to the hinge bolts 385*a*, 385*b*. In one embodiment of the present invention, the bolt fitting in the flange 440 of the mounting collar 170 is a captivated ball-nosed bolt for use in finely adjusting the elevation of the reflector, as will be described later. Also along the bottom of the mounting collar 170 is an arm 470 extending outward and capable of receiving a bolt. The arm 470 of the mounting collar 170 is in alignment with the arm 340 of the mounting cylinder 150 such that one bolt may pass through both holes. The bolt and arms are used to finely adjust the azimuth of the reflector, as discussed below.

Figure 6:
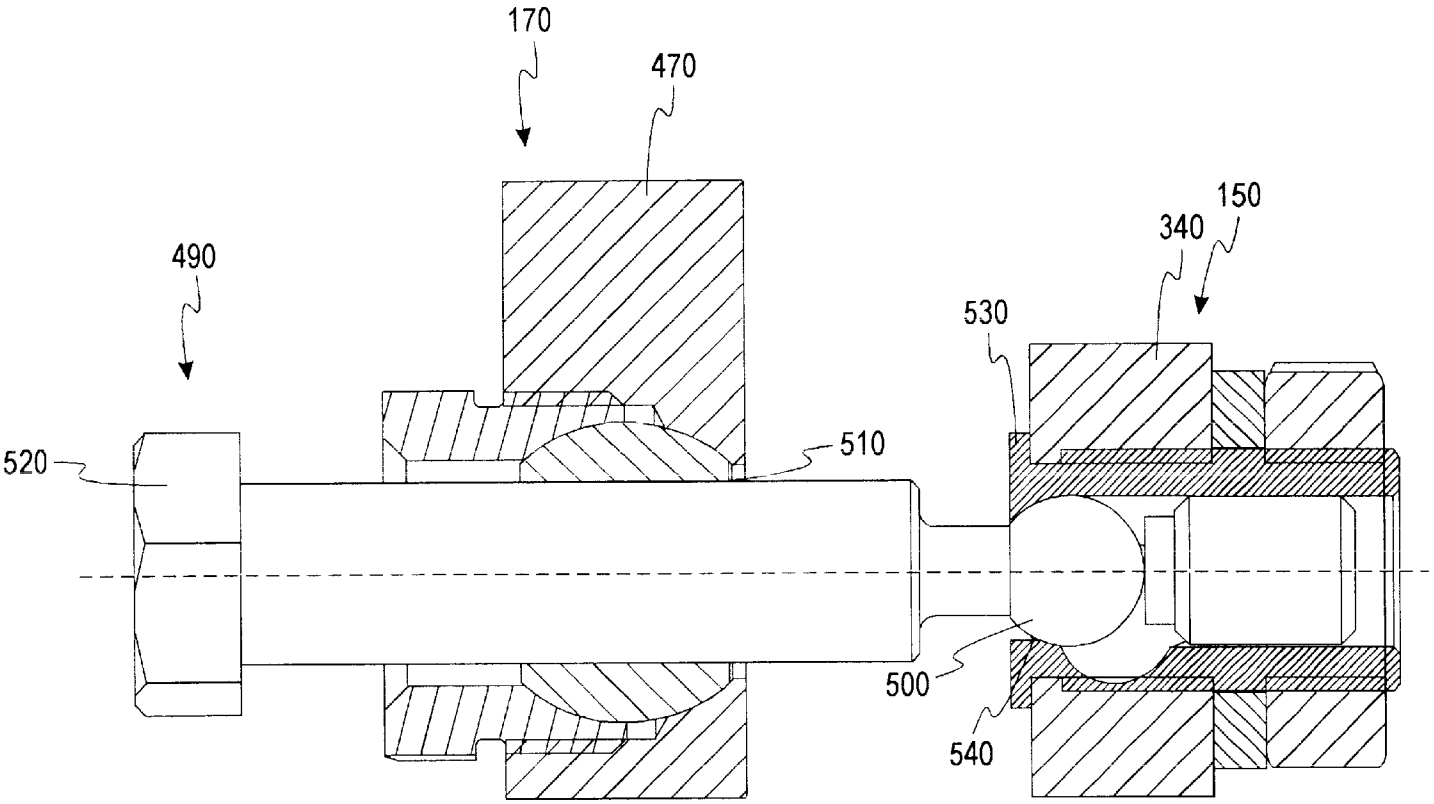
FIG. 6 is a cross-sectional view of a captivated ball-nosed bolt according to one embodiment of the present invention.

In the preferred embodiment shown in FIG. 6, a first captivated ball-nosed bolt 490 is provided to finely adjust the reflector 110 in the azimuthal direction and passes in one direction through both the arm 470 of the mounting collar 170 and the arm 340 of the mounting cylinder 150. The first captivated ball-nosed bolt 490 has a nose 500 which is ball-shaped, a threaded portion 510, and a hex portion 520. The nose 500 is locked into a casing 530 having an opening 540 with a diameter which is less than a diameter of the nose 500. The casing 530 is fit into the arm 340 of the mounting cylinder 150 such that the captivated bolt may not be moved in one direction relative to the mounting cylinder 150. The threaded portion 510 engages the through hole of arm 470 of the mounting collar 170, which is also threaded. The mounting collar 170 is, thus, adjustable relative to the first ball-nosed captivated bolt 490. As the hex 520 is rotated, the first captivated ball-nosed bolt 490 may not move relative to the mounting cylinder 150, but the threads are being forced to move, thus the mounting collar 170 is adjusted relative to the first captivated ball-nosed bolt 490 and the mounting cylinder 150. The reason for this will be described in more detail below with reference to FIG. 9.

It is also contemplated that another type of adjusting mechanism for fine adjustment in the azimuthal direction is used instead of a captivated ball-nosed bolt. For example, a captivated screw is contemplated, as are any other adjusting mechanisms which would lock the mounting cylinder 150 in one direction such that a rotation or movement of the mechanism would cause the mounting collar 170 to move in that same direction relative to the mounting cylinder 150.

Figure 7:
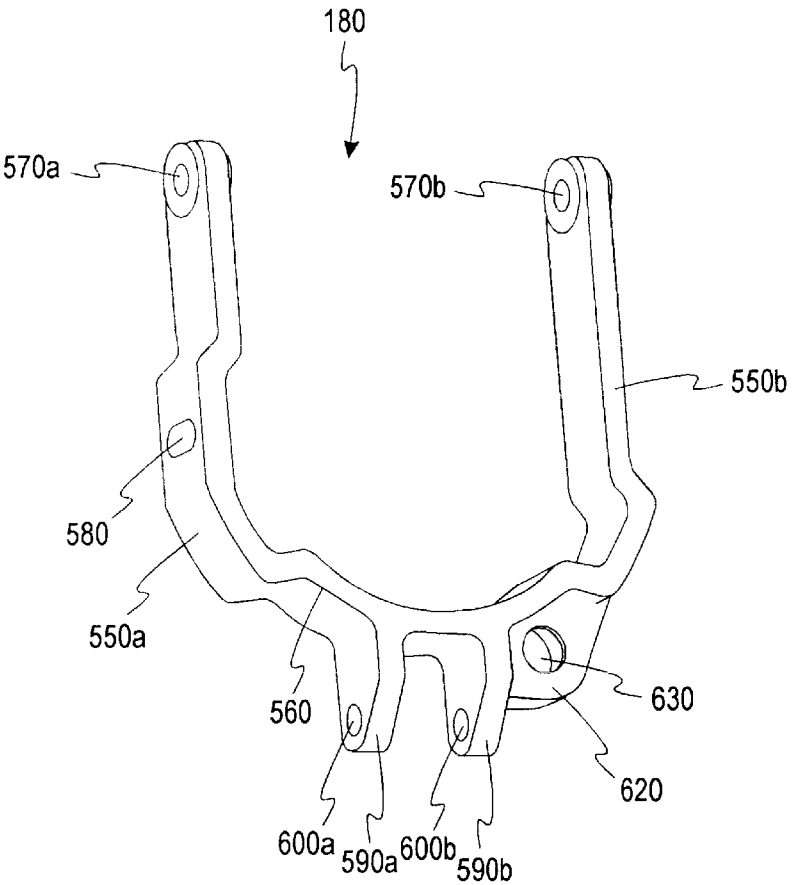
FIG. 7 is a top view of a u-shaped mount according to one embodiment of the present invention.
Figure 7:
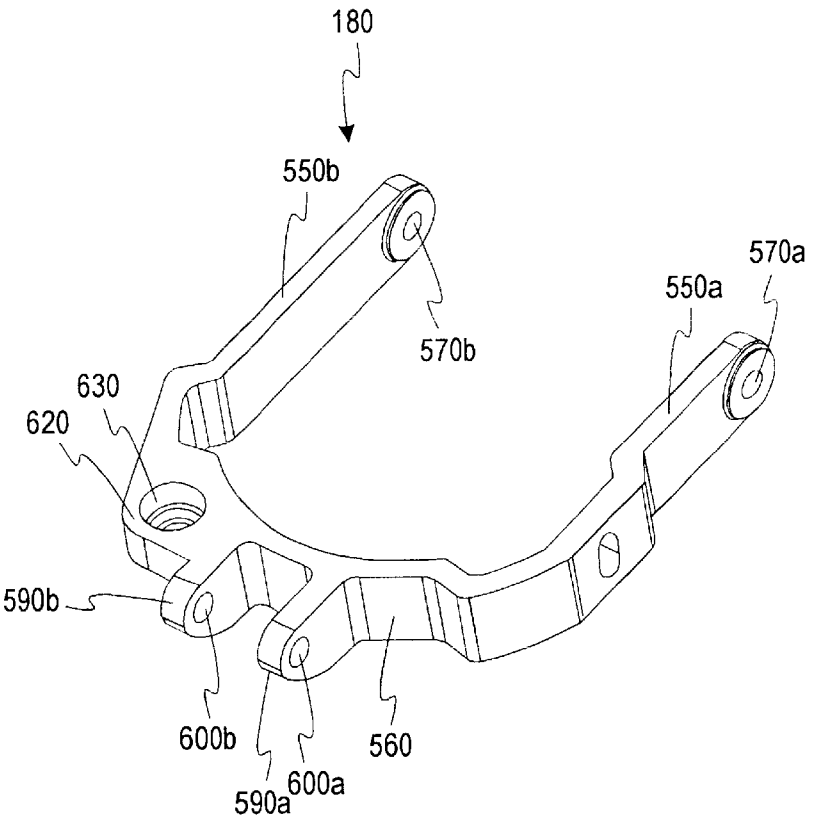
Figure 8:
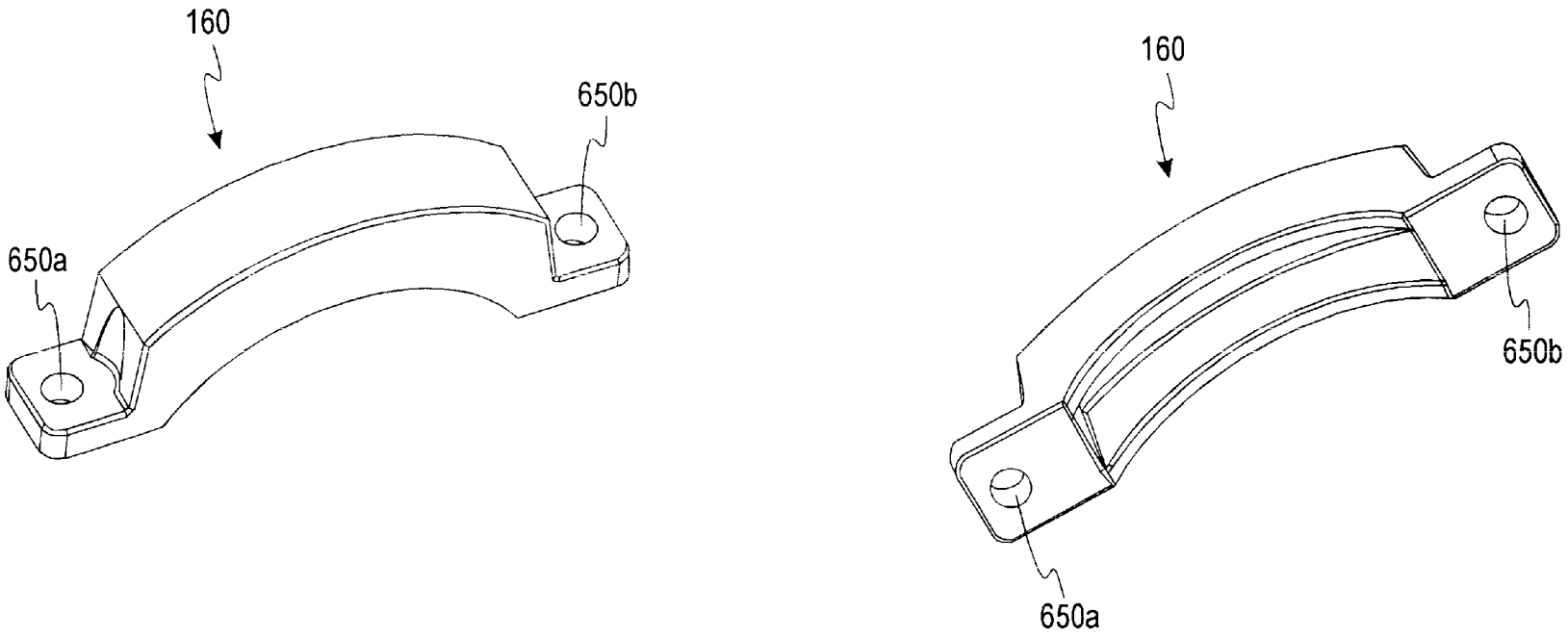
FIG. 8 is a perspective view of a mounting piece according to one embodiment of the present invention.

Encompassing the mounting collar 170 is the u-shaped mount 180, shown in FIG. 7. The u-shaped mount 180 comprises two prongs 550*a*, 550*b* and a curve portion 560 connecting the two prongs 550*a*, 550*b*. At the end of each of the two prongs 550*a*, 550*b* are through holes 570*a*, 570*b*, each capable of accepting a hinge bolt. The through holes 570*a*, 570*b* at the end of the two prongs 550*a*, 550*b* are in alignment with the two feet 380*a*, 380*b*, respectively, of the mounting collar 170. Hinge bolts 385*a*, 385*b* are received into the prong 550*a*, foot 380*a* combination, and the prong 550*b*, foot 380*b* combination, respectively. The through holes are then included in the mechanism for locking the reflector at a particular elevation. Near a middle portion of one of the prongs 550*a* is another through hole 580 which is in alignment with the through hole on the side 390 of the mounting collar 170 such that the side bolt 410 passes through them both and, as discussed below, locks them in elevation. Extending outward from the curve portion 560 of the u-shaped mount 180 are two protrusions 590*a*, 590*b*, each with a through hole 600*a*, 600*b* capable of accepting a bolt 610. The two protrusions 590*a*, 590*b* are in alignment such that the same bolt 610 passes through them both. The bolt 610 will be used to coarsely lock the reflector at an elevation. Although this mount is a u-shaped mount 180, other shapes are contemplated that would encompass at least a portion of the mounting collar 170 and be pivotable relative to the mounting collar 170. For example, a ringed mount may also be used.

On the curve portion 560 of the u-shaped mount 180 is a flange 620 extending outwardly and in alignment with the flange 440 of the mounting collar 170. The outwardly extending flange 620 of the curve portion 560 also has a through hole 630 in alignment with the flange 440 of the mounting collar 170.

The outwardly extending flange 620 of the u-shaped mount 180 and the flange 440 of the mounting collar 170 are designed to accept a second captivated ball-nosed bolt 640. In the same manner as shown in FIG. 6, the second captivated ball-nosed bolt 640 acts in conjunction with the u-shaped mount and the mounting collar 150. The second captivated ball-nosed bolt 640 works to finely adjust the reflector in the elevational direction. The second captivated ball-nosed bolt 640 works in one direction while the first captivated ball-nosed bolt 490 works in a second direction. As stated above, it is contemplated that other adjusting mechanisms may be used in place of the second captivated ball-nosed bolt 640. The exact process for working the two bolts according to one embodiment of the present invention will be described below with reference to FIG. 9.

Turning now to FIG. 7, the c-shaped clamp 160 prohibits the rotational movement of the mounting cylinder relative to the mounting pipe. The c-shaped clamp 160 has two through holes 650*a*, 650*b* on opposite ends of the mount. The c-shaped clamp 160 is curved to fit on the edge 285 of the second annular portion 280*b* of the mounting cylinder 150, such that the two through holes 650*a*, 650*b* of the c-shaped clamp 160 are in alignment with the two through holes 295*a*, 295*b* on the second annular portion 280*b* of the mounting cylinder 150. The mounting cylinder 150 and the c-shaped clamp 160 are positioned such that the same clamp bolts 300*a*, 300*b* fit through both. Thus, the c-shaped clamp acts as a clamp on the mounting cylinder 150, coarsely locking the mounting cylinder 150 at an azimuth angle, as will be more fully discussed below.

Returning now to FIG. 2, it is seen that the two prongs 550*a*, 550*b* of the u-shaped mount 180 may be connected to the two support arms 660*a*, 660*b* by the two hinge bolts 385*a*, 385*b*. The two hinge bolts 385*a*, 385*b* go through the two prongs 550*a*, 550*b* and engage the mounting collar 170, as well. The support arms 660*a*, 660*b* extend upwardly and are welded to the mounting plate 190 to provide support for the reflector. The support arms 660*a*, 660*b* may also be bolted, screwed, adhered, or affixed using other conventional methods to the mounting plate 190. When the two hinge bolts 385*a*, 385*b* are tightened, they hold the support arms 660*a*, 660*b* in a single position relative to the mounting plate 190. The support arms 660*a*, 660*b* also have a support beam 680 connecting them to increase the amount of pressure the support arms 660*a*, 660*b* can handle.

The mounting plate 190 attaches to the reflector 110 through a series of bolts 690 (shown in FIG. 1), although other means such as screws, adhesive, welding, and brazing are contemplated. The angular markings on the outer edge of the mounting plate 190 assist with establishing the position of the mounting plate 190 to the reflector 110. The mounting plate 190 is also attached to an adjustable strut 700. The adjustable strut 700 is rotatably attached to the mounting plate 190 via a bolt assembly 710 which is welded onto the mounting plate 190. The adjustable strut 700 is for adjusting the reflector 110 in elevation. Marked on the strut are a series of dashes for providing an indication of how far the reflector 110 has been adjusted.

Referring back to FIGS. 2 and 3, the adjustable strut 700 is connected to the protrusions of the u-shaped mount 180 by a connector 720. In one embodiment, the connector 720 is an I-shaped connector, although other types of connectors are contemplated. The connector 720 has a first arm (not shown) with an aperture in one direction, a middle arm 740 with an aperture in a perpendicular direction, and a third arm 750 with an aperture in the first direction. The first arm 730 of the connector 720 is rotatably held in between the two protrusions 590*a*, 590*b* by a bolt 760 which acts to keep the connector in place. The middle arm 740 accepts the adjustable strut 700. The third arm 750 includes two slightly separated pieces 770 which can be bolted together with a bolt 775. By tightening the bolt 775 through the separated pieces 770, the hole in the middle arm 740 is made smaller, and increases the hold on the adjustable strut 700. By loosening the bolt 775 through the separated pieces 770, the hole in the middle arm 740 is made larger, and the adjustable strut 700 may be moved relative to the u-shaped mount 180.

Figure 9:
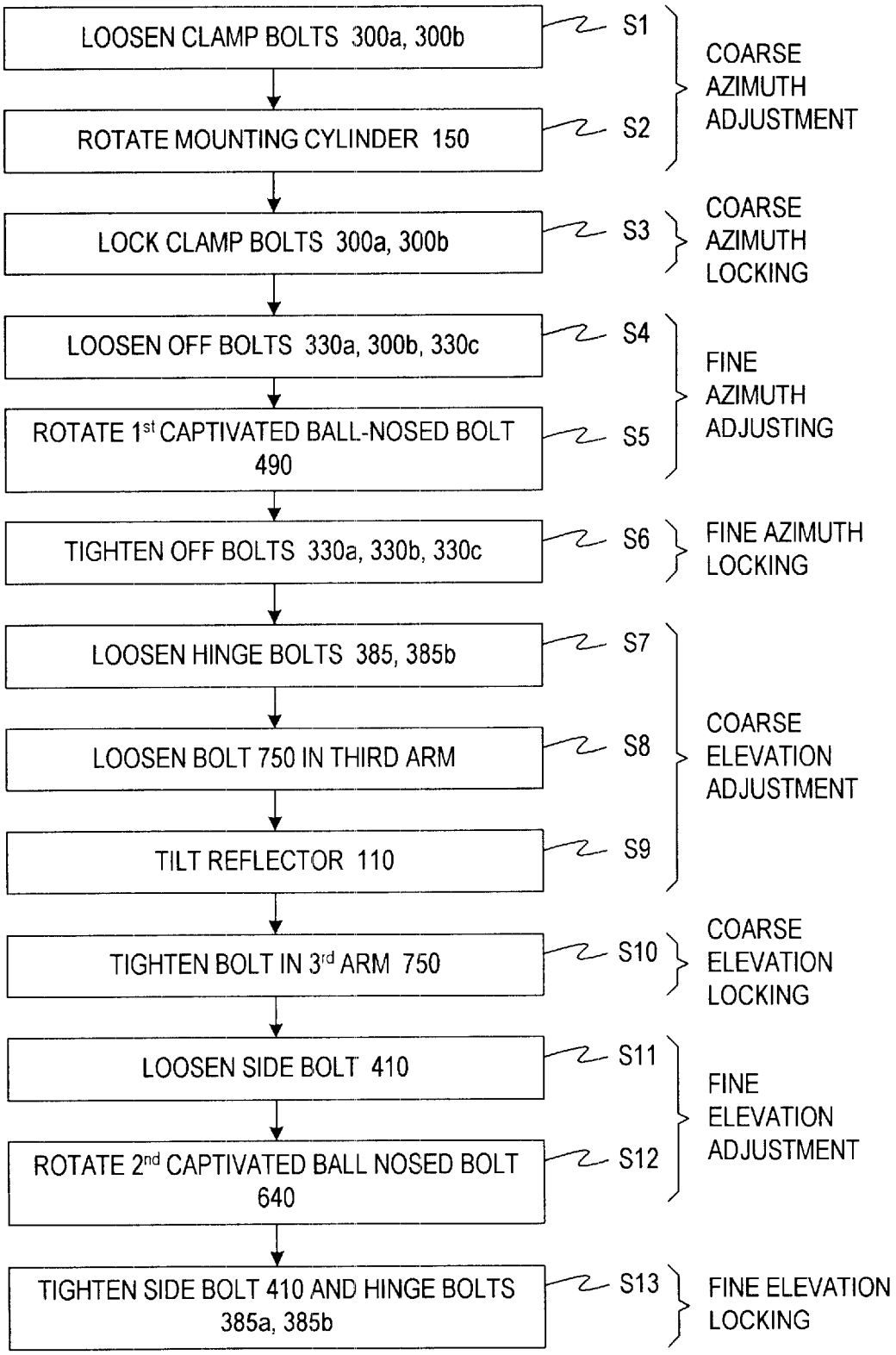
FIG. 9 is a flow chart describing a method for adjusting the azimuth and elevation of the antenna according to one embodiment of the present invention.

Turning now to FIG. 9, the process for adjusting the reflector 110 into the optimal position will be discussed. First, the coarse azimuth adjustment is described. To adjust the reflector 110 in the azimuth, a coarse adjustment is first made. As shown in step S1, the clamp bolts 300*a*, 300*b*, which connect the c-shaped clamp to the mounting cylinder 150, are loosened. When the clamp bolts 300*a*, 300*b* are loosened, the mounting cylinder 150 is rotatable relative to the mounting pipe 140. Next, in step S2, the mounting cylinder 150, along with the mounting collar 170 and the u-shaped mount 180, is rotated to within a predetermined range from the optimum azimuth direction. In one embodiment, the predetermined range is from +/−3°. The clamp bolts 300*a*, 300*b* are then locked in position, step S3. Once the clamped bolts are locked into position, the mounting cylinder 150 is locked in position relative to the mounting pipe 140.

The act of locking the clamp bolts 300*a*, 300*b* on the rotatable device may cause the reflector 110 to shift slightly out of position. To correct this problem, the present invention also provides for fine azimuthal adjustment which corrects any readjustment and has a greater precision than the coarse adjustment. At step S4, the off bolts 330*a*, 330*b*, 330*c*, which connect the mounting cylinder 150 to the mounting collar 170, are loosened. This allows the mounting collar 170 to be moved in the azimuth relative to the mounting cylinder 150. In step S5, the first captivated ball-nosed bolt 490 may be rotated to finely adjust reflector 110 in the azimuthal direction. As mentioned above, the first captivated ball-nosed bolt 490 is attached at its nose 500 to the mounting cylinder 150 such that the first captivated ball-nosed bolt 490 does not move in one direction relative to the mounting cylinder 150. The threaded portion 510 of the first captivated ball-nosed bolt 490 is threadably engaged with the mounting collar 170 such that when the first captivated ball-nosed bolt 490 is rotated, the mounting collar 170 moves relative to the first captivated ball-nosed bolt 490 and, thus, to the mounting cylinder 150. Since the reflector 110 is connected to the mounting collar 170, any adjustment to the mounting collar 170 is an adjustment to the reflector 110, as well.

Once the reflector 110 is placed within a predetermined range of the optimal azimuth location, the off bolts 330*a*, 330*b*, 330*c* are tightened to lock the reflector 110 in the azimuth position, step S6. The tightening of the off bolts 330*a*, 330*b* causes the mounting collar 170 to be locked into position relative to the mounting cylinder 150 and the mounting pipe 140. Since the locking of the reflector 110 is in a location separate from the adjustment, the tightening does not affect the movement of the first captivated ball-nosed bolt 490 relative to the mounting collar 170. More specifically, in the embodiment shown, the tightening of the off bolts 330*a*, 330*b*, 330*c* takes place in a plane different than the plane of the adjustment of the first captivated ball-nosed bolt 490. Therefore, the tightening does not affect movement in the plane of the adjustment.

Turning now to step S7, the coarse elevation adjustment will now be described. At step S7, the hinge bolts 385*a*, 385*b* connecting the supporting arms to the u-shaped mount 180 and the mounting collar 170 are loosened while holding the antenna. Next, at step S8, the bolt in the third arm 750 of the I-connector 720 is loosened. This action frees the adjustable strut 700 to slide relative to the I-connector 720 and, thus, the u-shaped mount 180. The antenna 100 can now be tilted to the desired elevation, which is indicated by the scale on the adjustable strut 700, at step S9. This is done within a predetermined range from the optimal position. In one embodiment, the optimal position is +/−3°. Step S10 comprises tightening the bolt in the third arm 750 of the I-connector 720. The adjustable strut 700 or elevation strut is now locked into place relative to the u-shaped mount 180.

To provide for fine adjustment in the elevational direction, at step S1, the side bolt 410 is loosened, which allows movement between the u-shaped mount 180 and the mounting collar 170. The second captivated ball-nosed bolt 640 is rotated to fine tune the elevation during step S12. Since the hinge bolts 385*a*, 385*b* are in a fixed location, they act as a pivot point while loose, such that when the second captivated ball-nosed bolt 640 is rotated clockwise, the prong ends of the u-shaped mount 180 may move slightly upward, increasing the elevation. As the second captivated ball-nosed bolt 640 is rotated counterclockwise, the prong ends move slightly downward, decreasing the elevation. Once the desired location is reached at step S13, the hinge bolts 385*a*, 385*b* and the side bolt 410 are tightened. The tightening locks the reflector 110 in position. As in relation to the azimuth, since the locking is done in a location separate from the adjusting, the fine tuning is not affected by the tightening of the bolts. Thus, the antenna 100 is locked into an optimal location.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A reflector-type microwave antenna to be mounted on a structure comprising:

a paraboloidal reflector having a focal point;

a feed horn located at said focal point of said paraboloidal reflector, said feed horn adapted to launch microwave signals onto said reflector and to receive microwave signals from said paraboloidal reflector;

a mounting pipe in a fixed location relative to the structure;

a mounting cylinder rotatably affixed to said mounting pipe;

a mounting collar affixed to said mounting cylinder;

a mounting plate connecting said mounting collar and said paraboloidal reflector such that a movement of said mounting collar causes a movement of said paraboloidal reflector;

an azimuth coarse adjuster in engagement with said mounting cylinder such that said mounting cylinder may be rotated relative to said mounting pipe, said azimuth coarse adjuster having an azimuth coarse adjuster locking mechanism capable of locking said mounting cylinder in a position relative to said mounting pipe;

an azimuth fine adjuster fixedly engaged to said mounting cylinder and rotatably engaged to said mounting collar, such that said azimuth fine adjuster may cause said mounting collar to rotate relative to said mounting cylinder; and an azimuth fine locking mechanism adapted to lock said mounting collar in a position relative to said mounting cylinder, wherein said azimuth fine adjuster is located away from said azimuth fine adjuster such that when said locking mechanism is moved, said azimuth fine adjuster remains fixed.

2. The antenna according to claim 1, further comprising:

a u-shaped mount having a first end and a second end abutting said mounting collar;

an elevation coarse adjuster connecting said u-shaped mount and said mounting plate such that said u-shaped mount may be rotated relative to said mounting plate, said elevation coarse adjuster having an elevation coarse adjuster locking mechanism adapted to lock said u-shaped mount in a position relative to said mounting plate;

an elevation fine adjuster connected to said second end of said u-shaped mount such that a rotation of said fine adjuster causes said first end of said u-shaped mount to pivot relative to said mounting pipe; and an elevation fine locking mechanism adapted to lock said mounting collar in an elevation position relative to said u-shaped mount, mounting plate, and paraboloidal reflector, wherein said elevation fine locking mechanism is located away from said elevation fine adjuster such that when said locking mechanism is moved, said elevation fine adjuster remains fixed.

3. The antenna according to claim 2, wherein said azimuth coarse adjuster comprises a pair of flanges on said mounting cylinder, a c-shaped clamp, and a pair of bolts attaching said c-shaped clamp to said pair of flanges, said bolts are affixed such that when said bolts are loosened, said mounting cylinder is able to rotate relative to said mounting pipe and when said bolts are tightened, said mounting cylinder is locked in a position relative to said mounting pipe.

4. The antenna according to claim 3, wherein said azimuth fine adjuster comprises a captivated ball-nosed bolt having a nose and a threaded portion, said nose adapted to be held in a fixed relationship with said mounting cylinder, said threaded portion adapted to engage a plurality of threads on said mounting collar such that a rotation of said captivated ball-nosed bolt causes a rotation of said mounting collar.

5. The antenna according to claim 4, wherein said captivated ball-nosed bolt moves in a predetermined plane.

6. The antenna according to claim 5, wherein said azimuth fine locking mechanism comprises at least one bolt on said mounting collar, said at least one bolt being adapted to be loosened and tightened, such that when said at least one bolt is loosened, said mounting collar may be rotated relative to said mounting cylinder and when said at least one bolt is tightened, said mounting collar is fixed relative to said mounting cylinder.

7. The antenna according to claim 6, wherein said at least one bolt is in a plane other than said predetermined plane of said captivated ball-nosed bolt.

8. The antenna according to claim 2, wherein said elevation coarse adjuster comprises a pair of feet on said mounting collar, an adjustable strut slideably engaged to said u-shaped mount, a pair of feet on said u-shaped mount, a pair of support arms connected to said mounting plate, a pair of hinge bolts rotatably attaching said support arms to said feet of said mounting collar and said feet of said u-shaped mount, and a connector bolt, said hinge bolts and slide bolt are affixed such that when said hinge bolts and slide bolt are loosened, said mounting adjustable strut is able to slide relative to said u-shaped mount and when said slide bolt is tightened, said adjustable strut is locked in a position relative to said u-shaped mount.

9. The antenna according to claim 8, wherein said elevation fine adjuster comprises a captivated ball-nosed bolt having a nose and a threaded portion, said nose adapted to be held in a fixed relationship with said mounting collar, said threaded portion adapted to engage a plurality of threads on said u-shaped mount such that a rotation of said captivated ball-nosed bolt causes a rotation of said u-shaped mount relative to said mounting collar.

10. The antenna according to claim 9, wherein said captivated ball-nosed bolt moves in a predetermined plane.

11. The antenna according to claim 10, wherein said elevation fine locking mechanism comprises at least one bolt on a side of said u-shaped mount, said at least one bolt also connected to said mounting collar, said at least one bolt being adapted to be loosened and tightened, such that when said at least one bolt is loosened, said u-shaped mount may be rotated relative to said mounting collar and when said at least one bolt is tightened, said u-shaped mount is fixed relative to said mounting collar.

12. The antenna according to claim 11, wherein said at least one bolt is in a plane other than said predetermined plane of said captivated ball-nosed bolt.

13. A reflector-type microwave antenna to be mounted on the structure comprising:

a paraboloidal reflector having a focal point;

a feed horn located at said focal point of said paraboloidal reflector, said feed horn adapted to launch microwave signals onto said reflector and to receive microwave signals from said paraboloidal reflector;

a mounting pipe in a fixed location relative to the structure;

a mounting collar;

a u-shaped mount having a first end and a second end, said second end abutting said mounting collar;

a mounting plate fixedly attached to said paraboloidal reflector and rotatably attached to said u-shaped mount;

an elevation coarse adjuster connecting said u-shaped mount to said mounting plate such that said mounting plate may be adjusted relative to said mounting pipe, said elevation coarse adjuster having an elevation coarse adjuster locking mechanism adapted to lock said u-shaped mount in a position relative to said mounting plate;

an elevation fine adjuster in engagement with said u-shaped mount and said mounting collar such that a rotation of said fine adjuster causes said u-shaped mount to pivot relative to said mounting pipe; and an elevation fine locking mechanism adapted to lock said mounting collar in an elevation position relative to said u-shaped mount, mounting plate, and paraboloidal reflector, wherein said elevation fine locking mechanism is located away from said elevation fine adjuster such that when said locking mechanism is moved, said elevation fine adjuster remains fixed.

14. The antenna according to claim 13, further comprising:

a mounting cylinder rotatably affixed to said mounting pipe;

an azimuth coarse adjuster adapted to engage said mounting cylinder such that said mounting cylinder may be rotated in azimuth relative to said mounting pipe, said azimuth coarse adjuster having an azimuth coarse adjuster locking mechanism capable of locking said mounting cylinder in a position relative to said mounting pipe;

an azimuth fine adjuster fixedly engaged to said mounting cylinder and rotatably engaged to said mounting collar, such that said azimuth fine adjuster may rotate in azimuth said mounting collar relative to said mounting cylinder; and an azimuth fine locking mechanism adapted to lock said mounting collar in a position relative to said mounting cylinder, wherein said azimuth fine adjuster is located away from said azimuth fine adjuster such that when said locking mechanism is moved, said azimuth fine adjuster remains fixed.

15. A method for positioning a reflector-type microwave antenna in an optimal azimuth and elevation directions comprising:

providing a paraboloidal reflector having a focal point;

providing a feed horn located in said focal point of said paraboloidal reflector and adapted to transmit and receive microwave signals to and from said paraboloidal reflector;

fixedly attaching a mounting; plate to said paraboloidal reflector;

attaching a mounting collar to said mounting plate;

attaching a mounting cylinder to said mounting collar;

attaching a mounting pipe to said mounting cylinder, wherein said mounting pipe is in a fixed position;

adjusting said mounting cylinder in azimuth relative to said mounting pipe;

locking said mounting cylinder in an azimuth position relative to said mounting pipe;

adjusting said mounting collar in azimuth relative to said mounting cylinder until a desired azimuth position is reached; and locking said mounting collar in azimuth relative to said mounting cylinder such that said mounting collar remains in said desired azimuth position.

16. The method of claim 15, further comprising:

attaching said mounting collar to said mounting plate;

attaching a u-shaped mount to said mounting collar;

attaching a mounting pipe to said mounting collar, wherein said mounting pipe is in a fixed position;

adjusting said u-shaped mount in elevation;

locking said u-shaped mount in an elevation position relative to said mounting plate;

adjusting said u-shaped mount in elevation relative to said mounting collar until a desired elevation position is reached; and locking said u-shaped mount in elevation relative to said mounting collar such that said mounting collar remains in said desired azimuth position.

17. A method for positioning a reflector-type microwave antenna in an optimal azimuth and elevation directions comprising:

providing a paraboloidal reflector having a focal point;

providing a feed horn located in said focal point of said paraboloidal reflector and adapted to transmit and receive microwave signals to and from said paraboloidal reflector;

fixedly attaching a mounting plate to said paraboloidal reflector;

attaching a mounting collar to said mounting plate;

attaching a u-shaped mount to said mounting collar;

fixedly attaching a mounting pipe to said mounting collar, wherein said mounting pipe is in a fixed position;

adjusting said u-shaped mount in elevation;

locking said u-shaped mount in an elevation position relative to said mounting plate;

adjusting said u-shaped mount in elevation relative to said mounting collar until a desired elevation position is reached; and locking said u-shaped mount in elevation relative to said mounting collar such that said mounting collar remains in said desired azimuth position.

18. The method according to claim 17, further comprising:

attaching a mounting cylinder to said mounting collar;

attaching said mounting pipe to said mounting cylinder, wherein said mounting pipe is in a fixed position;

adjusting said mounting cylinder in azimuth relative to said mounting pipe;

locking said mounting cylinder in an azimuth position relative to said mounting pipe;

adjusting said mounting collar in azimuth relative to said mounting cylinder until a desired azimuth position is reached; and locking said mounting collar in azimuth relative to said mounting cylinder such that said mounting collar remains in said desired azimuth position.

19. A method for positioning a reflector-type microwave antenna in an optimal azimuth and elevation directions comprising:

providing a paraboloidal reflector having a focal point;

providing a feed horn located in said focal point of said paraboloidal reflector and adapted to transmit and receive microwave signals to and from said paraboloidal reflector;

fixedly attaching a mounting; plate to said paraboloidal reflector;

attaching a mounting collar to said mounting plate;

attaching a mounting cylinder to said mounting collar;

attaching a mounting pipe to said mounting cylinder, wherein said mounting pipe is in a fixed position;

coarsely adjusting said mounting cylinder in azimuth relative to said mounting pipe to an azimuth position within a predetermined range;

locking said mounting cylinder in said azimuth position relative to said mounting pipe;

providing a fine azimuth adjuster adapted to adjust said reflector in azimuth in a first predetermined plane;

using said fine azimuth adjuster to finely adjusting said mounting collar in azimuth relative to said mounting cylinder until an azimuth position is reached;

providing an azimuth fine locking mechanism adapted to lock said reflector in azimuth relative to said mounting pipe, wherein said locking mechanism acts in a plane different than said first plane;

using said azimuth fine locking mechanism to lock said mounting collar in azimuth relative to said mounting cylinder such that said mounting collar remains in said azimuth position;

attaching said mounting collar to said mounting plate;

attaching a u-shaped mount to said mounting collar and to said mounting plate;

fixedly attaching said mounting pipe to said mounting collar, wherein said mounting pipe is in a fixed position;

adjusting said u-shaped mount in elevation;

locking said u-shaped mount in an elevation position relative to said mounting plate;

providing a fine elevation adjuster adapted to adjust said u-shaped mount in elevation and located in a predetermined second plane;

using said fine elevation adjuster to adjust said u-shaped mount in elevation relative to said mounting collar until a desired elevation position is reached;

providing a fine elevation locking mechanism to lock said u-shaped mount in elevation relative to said mounting collar, said fine elevation locking mechanism provided in a plane different than said second plane; and using said fine elevation locking mechanism to lock said u-shaped mount in elevation relative to said mounting collar such that said mounting collar remains in said desired azimuth position.

20. A reflector-type microwave antenna comprising:

a paraboloidal reflector having a focal point;

a feed horn located at the focal point of said paraboloidal reflector, said feed horn adapted to launch microwave signals onto said reflector and to receive microwave reflectors from said paraboloidal reflector;

a mounting pipe in a fixed location;

a mounting cylinder rotatably affixed to said mounting pipe and having two flanges, each adapted to accept a clamp bolt, said mounting cylinder further having an arm;

a mounting collar affixed to said mounting cylinder and having an arm with a threaded portion;

a mounting plate affixed to said mounting collar and to said paraboloidal reflector such that a movement of said mounting collar causes a movement of said paraboloidal reflector;

a c-shaped clamp attached to said two flanges of said mounting cylinder by said clamp bolts, and adapted to act as a clamp, such that when said clamp bolts are loosened, said mounting cylinder may move relative to said mounting pipe and when said clamp bolts are tightened, said c-shaped clamp tightens onto said mounting cylinder, locking said mounting cylinder in a position relative to said mounting pipe;

a captivated ball-nosed bolt in a first plane and having a nose and a threaded portion, wherein said nose connects to said mounting cylinder and is locked in a position relative to said mounting cylinder and said threaded portion engages said threaded portion of said mounting collar, such that when said captivated ball-nosed bolt is rotated, said mounting collar moves relative to said mounting cylinder; and at least one off bolt in a plane different from said first plane and connecting said mounting cylinder to said mounting collar such that when said at least one off bolt is tightened, said mounting collar is locked in a position relative to said mounting cylinder.

21. A reflector-type microwave antenna, comprising:

a parabolic reflector assembly mounted on a mounting plate and having means for receiving and sending signals;

a first mounting structure having a hinge portion, said parabolic reflector being pivotable around said hinge portion;

an elevation coarse adjuster connected to said mounting plate for adjusting the elevation of said parabolic reflector by rotating said parabolic reflector around said hinge portion; and an elevation fine adjuster adapted to move a segment of said first mounting structure positioned away from said hinge portion upwardly or downwardly.

22. The antenna of claim 21, wherein said first structure is a U-shaped structure.

23. The antenna of claim 21, wherein said elevation coarse adjuster is connected to said first mounting structure.

24. The antenna of claim 21, wherein said elevation coarse adjuster is a rod having markings thereon.

25. The antenna of claim 21, wherein said elevation coarse adjuster includes a locking mechanism for locking said first mounting structure relative to said mounting plate.

26. The antenna of claim 21, wherein said elevation fine adjuster rotates said first mounting structure around said hinge portion while the relative position of said mounting plate and said first mounting structure is fixed.

27. The antenna of claim 21, further including an elevation fine locking mechanism adapted to lock said first mounting structure relative to a separate base structure.

28. The antenna of claim 21, wherein said elevation fine adjuster is a ball-nosed bolt.

29. A reflector-type microwave antenna, comprising:

a parabolic reflector assembly mounted on a mounting plate and having means for receiving and sending signals;

a first elevation adjuster connected to said mounting plate for coarsely adjusting an elevational direction of said parabolic reflector by rotating said parabolic reflector around a hinge; and a second elevation adjuster for finely adjusting the elevation of said parabolic reflector, said second elevation adjuster being distinct from said first elevation adjuster.

30. The antenna of claim 29, wherein said first elevation adjuster is a rod having markings thereon.

31. The antenna of claim 29, wherein said first elevation adjuster includes a first locking mechanism for locking said first elevation adjuster in a desired position.

32. The antenna of claim 31, wherein said second elevation adjuster is adapted to move said mounting plate upwardly and downwardly while said first locking mechanism is locked.

33. The antenna of claim 32, wherein said second elevation adjuster can move the mounting plate within three degrees of said desired position.

34. The antenna of claim 29, further including a second elevation adjuster locking mechanism for locking said mounting plate relative to a fixed base structure.

35. The antenna of claim 29, wherein said second elevation adjuster is a ball-nosed bolt.

36. A reflector-type microwave antenna, comprising:

a parabolic reflector assembly mounted on a mounting plate and having means for receiving and sending signals, said mounting plate being fixedly coupled to a structure;

a mounting cylinder rotationally coupled with said structure;

a first azimuthal adjustment mechanism on said mounting cylinder for coarsely adjusting an azimuthal position of said parabolic reflector assembly; and a second azimuthal adjustment mechanism for finely adjusting the azimuthal position of said parabolic reflector assembly by adjusting the rotational position of said structure relative to said mounting cylinder.

37. The antenna of claim 36, wherein said first azimuthal adjustment mechanism is a first portion of said mounting cylinder.

38. The antenna of claim 36, wherein said first azimuthal adjustment mechanism includes a first locking mechanism for locking said mounting cylinder after a desired position is attained.

39. The antenna of claim 38, wherein said first locking mechanism is a c-shaped clamp.

40. The antenna of claim 36, wherein said second azimuthal adjuster rotates said mounting plate relative to said mounting cylinder, while the relative position of said mounting cylinder is fixed.

41. The antenna of claim 36, further including a second azimuthal locking mechanism for locking said mounting plate relative to a fixed base structure.

42. The antenna of claim 36, wherein said second azimuthal adjuster is a ball-nosed bolt.

43. A reflector-type microwave antenna, comprising:

a parabolic reflector assembly having means for receiving and sending signals;

a first azimuthal adjustment mechanism for coarsely adjusting an azimuthal position of said parabolic reflector assembly, said first azimuthal adjustment mechanism having a locking mechanism that is locked after a desired position is attained; and a second azimuthal adjuster for finely adjusting the azimuthal position of said parabolic reflector assembly while said locking mechanism is engaged.

44. The antenna of claim 43, further including:

a first elevation adjuster connected to said parabolic reflector assembly for coarsely adjusting an elevational direction of said parabolic reflector assembly by rotating said parabolic reflector around a hinge; and a second elevation adjuster for finely adjusting the elevation of said parabolic reflector, said second elevation adjuster being distinct from said first elevation adjuster.

45. The antenna of claim 43, further comprising a mounting cylinder, wherein said first azimuthal adjustment mechanism is a first portion of said mounting cylinder.

46. The antenna of claim 43, wherein said locking mechanism is a c-shaped clamp.

47. The antenna of claim 43, further including a second azimuthal locking mechanism for locking said parabolic reflector assembly relative to a fixed base structure.

48. The antenna of claim 43, wherein said second azimuthal adjuster is a ball-nosed bolt.

49. The antenna of claim 43, wherein said second azimuthal adjuster can move the reflector within three degrees of the desired position.

50. A reflector-type microwave antenna, comprising:

a parabolic reflector assembly mounted on a mounting plate;

a first mounting structure having a hinge portion, said parabolic reflector being pivotable around said hinge portion;

a marked rod connected to said mounting plate for adjusting the elevation of said parabolic reflector, said rod having a locking mechanism that is locked after a desired position is attained; and a u-shaped clamp coupled to and for moving said mounting plate upwardly or downwardly within approximately three degrees of said desired position.

51. A reflector-type microwave antenna, comprising:

a parabolic reflector assembly mounted on a mounting plate;

a mounting cylinder having a first portion, said first portion for coarsely adjusting an azimuthal position of said parabolic reflector assembly to a first position, said mounting cylinder connected to said mounting plate and having a locking mechanism that is locked after a second position is attained; and a mounting collar coupled to said mounting cylinder and for rotating said mounting plate within approximately three degrees of the second position after said locking mechanism is locked.

52. A method for positioning a reflector-type microwave antenna in an optimal azimuth direction comprising:

(a) coarsely adjusting said antenna in the azimuth direction to a first position;

(b) locking said antenna in a position that is within a slight distance from said first position relative to a mounting structure;

(c) finely adjusting said antenna in the azimuth direction with a mechanism that is different from the mechanism used for said coarsely adjusting; and (d) locking said antenna after said finely adjusting.

53. The method of claim 52, wherein said locking of step (b) disturbs said antenna from said first position and moves said antenna said slight distance from said first position.

54. The method of claim 52, wherein said step of finely adjusting said antenna comprises moving said antenna back to said first position.

55. The method of claim 54, wherein said locking of step (d) does not disturb said antenna from said first position.

56. The method of claim 52, wherein slight distance is within three degrees of said first position.

57. A method for positioning a reflector-type antenna in an optimal elevation direction comprising:

(a) coarsely adjusting said antenna in the elevation direction to a first position;

(b) locking said antenna in a position that is within a slight distance from said first position;

(c) finely adjusting said antenna in the elevation direction with a mechanism that is different from the mechanism used for said coarsely adjusting; and (d) locking said antenna after said finely adjusting.

58. The method of claim 57, wherein said locking of step (b) disturbs said antenna from said first position arid moves said antenna said slight distance from said first position.

59. The method of claim 58, wherein said step of finely adjusting said antenna comprises moving said antenna back to said first position.

60. The method of claim 57, wherein said locking of step (d) does not disturb said antenna from said first position.

61. The method of claim 57, wherein said slight distance is within three degrees of said first position.

* * * * *